US006842981B2

(12) United States Patent
Kennelly et al.

(10) Patent No.: US 6,842,981 B2
(45) Date of Patent: Jan. 18, 2005

(54) MANUFACTURE OF TRUSSES

(75) Inventors: Bernard Joseph Kennelly, North Balgowlah (AU); John Edwin Griffith, Castle Hill (AU)

(73) Assignee: Turb-O-Web International Pty. Limited, Quakers Hill (AU)

( * ) Notice: Subject to any disclaimer, the term of this patent is extended or adjusted under 35 U.S.C. 154(b) by 0 days.

(21) Appl. No.: 10/739,283

(22) Filed: Dec. 19, 2003

(65) Prior Publication Data

US 2004/0154260 A1 Aug. 12, 2004

Related U.S. Application Data

(62) Division of application No. 09/779,040, filed on Feb. 8, 2001, now Pat. No. 6,688,067, which is a continuation of application No. 08/854,952, filed on May 13, 1997, now Pat. No. 6,249,972.

(30) Foreign Application Priority Data

May 16, 1996 (AU) ..... PN9587
Sep. 17, 1996 (AU) ..... P02384
Nov. 8, 1996 (AU) ..... P03533

(51) Int. Cl.[7] ..... B23P 19/04
(52) U.S. Cl. ..... 29/897.31; 52/639; 52/90.1
(58) Field of Search ..... 29/897.31, 897.312, 29/897.3; 52/639, 634, 638, 90.1, 633

(56) References Cited

U.S. PATENT DOCUMENTS

| | | | |
|---|---|---|---|
| 2,021,480 | A | 11/1935 | Davidson |
| 2,372,768 | A | 4/1945 | Davison |
| 2,844,852 | A | 7/1958 | West |
| 3,345,792 | A | 10/1967 | Chandler |
| 3,867,803 | A | 2/1975 | Platt |
| 3,947,309 | A | 3/1976 | Troutner |
| 4,005,556 | A | 2/1977 | Tuomi |
| 4,030,264 | A | 6/1977 | Jackson |
| 4,274,241 | A | 6/1981 | Lindal |
| 4,288,961 | A | 9/1981 | Snow, Jr. et al. |
| 4,294,050 | A | 10/1981 | Kandel |
| 4,393,637 | A | 7/1983 | Mosier |
| 4,414,787 | A | 11/1983 | Kappen |
| 4,501,102 | A | 2/1985 | Knowles |
| 4,516,363 | A | 5/1985 | Beaulieu et al. |
| 4,644,628 | A | 2/1987 | Coppa |
| 4,748,784 | A | 6/1988 | Dividoff et al. |
| 4,782,641 | A | 11/1988 | Manenti et al. |
| 4,836,436 | A | 6/1989 | Hannah |
| 5,361,495 | A | 11/1994 | Pyle et al. |
| 5,649,403 | A | 7/1997 | Haisch |
| 6,176,060 | B1 | 1/2001 | Kennelly et al. |
| 6,249,972 | B1 | 6/2001 | Kennelly et al. |

OTHER PUBLICATIONS

Stahl, Douglas C. et al., "Strength & Stiffness of Large–Gap Metal–Plate Wood Connection," Res. Pap. FPL–RP–535, Madison, WI, USDA, For. Serv. (1994).

Wolfe, Ronald W. et al., "Experimental Assessment of Wood Trusses With Square–End Webs," Res. Rap. FPL–RP–544, Madison, WI, USDA, For. Serv. (Jan. 1996).

Stahl, Douglas C. et al., "Behavior of Metal–Plate–Connected Trusses with Square–End Webs," *Forest Products Journal*, 46, No. 6, pp. 78–84 (Jun. 1996).

*Primary Examiner*—Teri P. Luu
*Assistant Examiner*—T. Nguyen
(74) *Attorney, Agent, or Firm*—Nixon & Vanderhye P.C.

(57) ABSTRACT

A plurality of wooden roof trusses for constructing a roof includes first and second wooden roof trusses. Each of the first and second wooden roof trusses includes a bottom chord and at least one upper chord obliquely disposed relative to the bottom chord. A first web is provided to the first wooden roof truss and a second web is provided to the second wooden roof truss. Each of the first and second webs has a tapered web end shape set without regard to a shape of a first and second joint, respectively, into which said tapered web end shapes of the first and second webs fit. The first and second webs are substantially identical in length and web end shape. The first and second webs are located at different positions in their respective first and second wooden roof trusses.

7 Claims, 8 Drawing Sheets

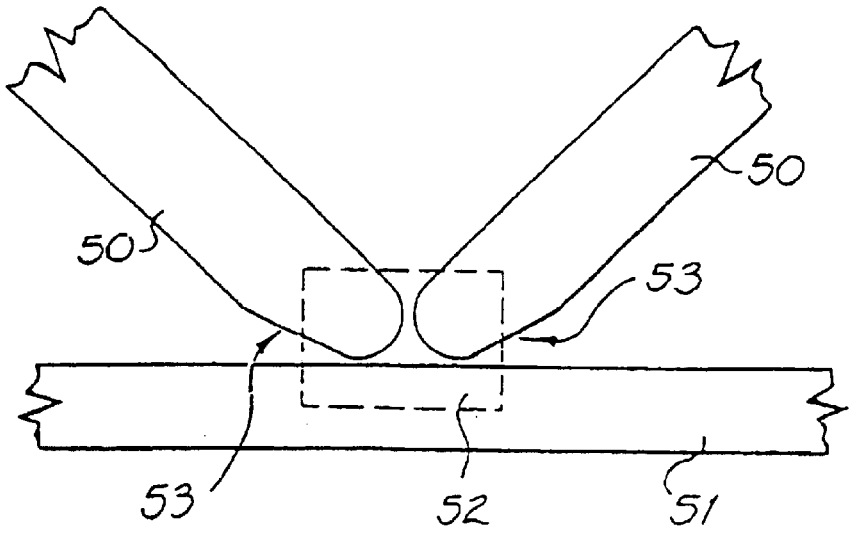
FIG. 7
FIG. 8
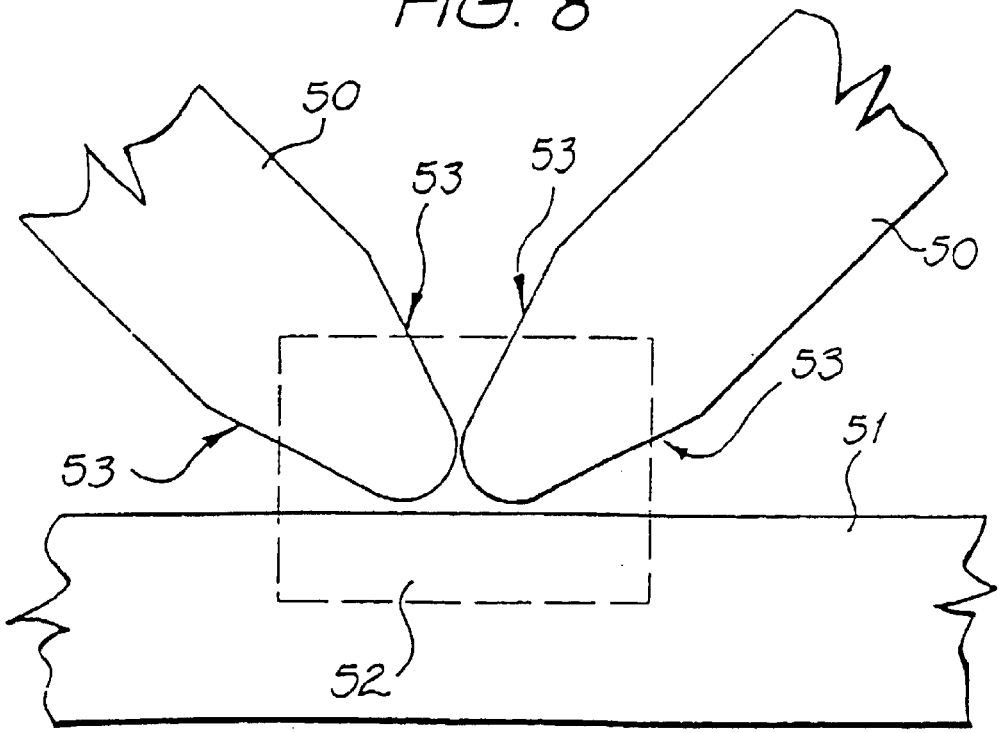

MANUFACTURE OF TRUSSES

This application is a divisional of application Ser. No. 09/779,040, filed Feb. 8, 2001, now U.S. Pat. No. 6,688,067 which is a continuation of U.S. application Ser. No. 08/854,952, filed May 13, 1997, now U.S. Pat. No. 6,249,972, each of which is incorporated herein by reference in its entirety.

BACKGROUND AND SUMMARY OF THE INVENTION

This invention relates to the manufacture of wooden roof trusses, of the kind including a bottom chord and at least one upper chord obliquely disposed in relation to the bottom chord, webs being connected between these chords.

In the manufacture of a set of such roof trusses it is customary to calculate, with the aid of a computer program, the composition of each truss according to span and loading, in the course of which the length and end cut geometry of each web, and its position in a truss, are determined. In a given set of trusses for a roofing job, there will be a great number of different webs which must be cut and correctly located during assembly.

We have found that it is possible to produce structurally satisfactory trusses in the varying sizes and types required in roofing construction, in which the webs are selected from a set of standard stock web lengths, with the panel points being determined by the successive selection of web lengths from stock lengths, and in which the ends of the webs are provided with a standard shape, set without regard to the geometry of the particular joints at which the ends are actually to be used.

In this way webs may be manufactured in advance of use and drawn from stock according to the specifications of a given job, with resultant cost savings.

In the preferred form of such webs, the ends are formed as semi-circles with a diameter substantially corresponding to the width of the web and their centres on the axis of the web.

U.S. Pat. No. 3,867,803 discloses a parallel chord joist truss in which the webs have such standardised end shapes. Unlike parallel chord trusses, however, the production of gable trusses and other roof trusses having oblique chords by the use of known procedures requires the production of webs of many specific lengths for a given job.

In its second aspect, the present invention provides methods of choosing a satisfactory web combination using the stock web lengths available, to achieve the desired structural performance. Whereas in the conventional approach, the panel points of the truss have been determined by the geometry of the chords (for example, where, in a so-called Fink truss, the panel lengths of the top chords are equalised, as are the panel lengths of the bottom chord, thus specifying the position of the panel points), in accordance with the present invention the actual panel points are determined by choosing webs from the stock lengths according to a predetermined scheme. The preferred schemes described herein relate the actual panel points defined by web selection to the panel points defined by panel length equalisation, for example by choosing a web length which will locate the actual panel point most closely on a predetermined side of the relevant notional panel point or by choosing webs which will contact the chords within provisionally determined panel point zones on the chords of the truss, the panel point zones being chosen on the basis of structural considerations.

In one such approach the invention provides a method of manufacturing wooden roof trusses of the kind having a bottom chord and at least one upper chord obliquely disposed relative to the bottom chord, the upper and bottom chords being connected by webs by means of nail-plated joints, characterised in that at least some of the webs are selected from a set of standard stock web lengths, and in that the ends of those webs are provided with a standard shape, set without regard to the geometry of the joints at which the ends are to be used.

Preferably the stock of webs comprises a set of web lengths which increase by equal increments between minimum and maximum lengths.

Preferably also the panel points of the truss are determined by the successive selection of web lengths from said stock.

In a particularly preferred form of the methods of the invention, the method includes the steps of a) determining notional panel points on the chords said panel points being joined by notational web lines b) choosing a starting point on a chord ("the starting chord")

c) choosing successive webs from the stock of standard lengths to form two alternating sets of webs such that (i) in the case of one set of alternate webs, each web is that for which the stock length is the longest not greater than the distance from the joint of the web with the starting chord to the notional panel point for that web on the opposite chord and (ii) in the case of the other set of alternate webs, each web is that for which the stock length is the shortest which is at least the distance from the connection of said web with the opposite chord to the intersection with the starting chord of a line passing through said joint and parallel to the notional line of the web.

Preferably in such a method where the length thus determined of a web of said other set of alternate webs is greater than the said distance from the connection of said web with said opposite chord to the intersection with the starting chord of said line, the joint of the second web with the starting chord is located on the side of said intersection remote from the starting point.

Preferably also the starting point is the apex of the truss, and the notional panel points of an upper chord are determined by dividing the chord into panels, preferably equal panels, and the notional panel points of the bottom chord are at the intersection with the bottom chord of lines, preferably normal to the upper chord, intersecting the upper chord at the notional panel points thereof.

In another approach to the criteria for web selection, target panel point zones are established on structural principles, and alternative methods used to determine an efficient web layout within the constraints of such zones. Such a method may include the steps of a) determining the maximum allowable panel lengths for each chord of the truss b) determining the minimum number of overlapping maximum panel lengths in each chord, the region of overlap thereof being referred to herein as panel point zones c) selecting webs from the stock range on the basis of chosen criteria including the requirement that the chosen web will connect with the chord within a target panel point zone previously determined for the next web-to-chord joint.

Each of these alternative methods is characterised by a stepwise procedure reiterated where necessary, in which, starting at a chosen point on the truss, preferably either (a) starting at the apex (or other point where the angle of the chord changes) and working toward the heels of the truss, or (b) starting at the heels and working toward the apex, or (c) starting with the provision of a king post and starting other web selection from the foot of the king post and working toward the heels webs are selected from the stock range on the basis of chosen criteria including the requirement that the chosen web will connect with the chord within a target panel point zone previously determined for the next web-to-chord joint.

One of these alternative methods begins by establishing all possible combinations of webs satisfying the requirement that they begin and end in a panel point zone. A choice is then made between these combinations on the basis of a pre-determined criterion or set of criteria. Suitable criteria for this purpose include (a) the sum of the individual departures of the panel points from the location of corresponding panel points in a standard solution, and (b) timber usage.

Other criteria may be adopted.

In the second of the alternative methods, webs are chosen on the basis of a parameter extreme, for example, (a) the web which hits the target panel point zone at a position within that zone closest to the starting point (eg. the apex or centre of the truss), (b) the shortest stock length which will reach the target panel point zone, c) the longest stock length which will reach the target panel point zone.

Other possible bases for web choice include choosing the web for which the included angle between the web and the chord is closest to a preferred angle for the panel point in question.

As a matter of convenience, the invention will be described primarily in its application to symmetrical trusses having a pair of upper chords meeting at a centrally located apex, but it is to be borne in mind that the invention may be applied, with appropriate modifications, to other types of trusses. Also as a matter of convenience, the trusses will be dealt with in the description of assembly methods in terms of single dimension line drawings, thereby avoiding the need to be concerned with web width and end shape, and with the choice of measurement conventions, for example the choice between the use of internal or external triangles. As is sell known, various conventions are used in defining truss dimensions, particularly chord length. Providing the structural implications of the convention employed are taken into account, however, the choice of convention is of no relevance to the present invention.

GRIEF DESCRIPTIONS OF THE DRAWINGS

In the drawings,

FIGS. 7 to 9 illustrate web to chord joints employing alternative web end shapes;

Figure 20:
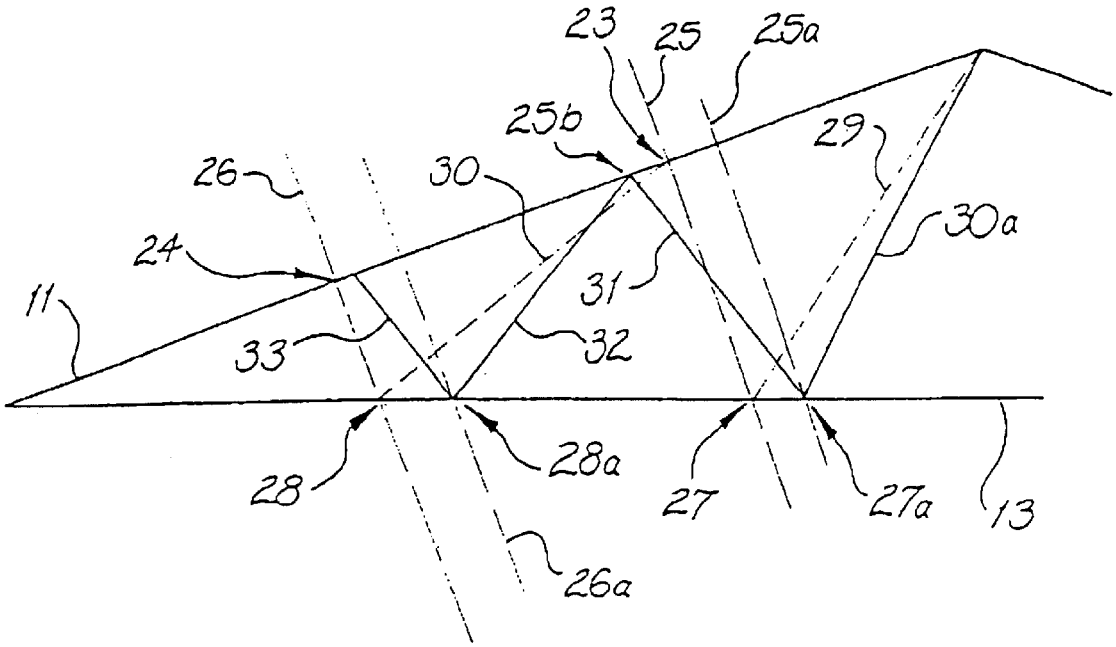

FIGS. 10 to 14 schematically illustrate a method of web selection according to one embodiment of the invention;

FIGS. 15 to 19 schematically illustrate a method of web selection according to another embodiment of the invention; and FIG. 20 schematically illustrates a method of web selection according to another embodiment of the invention.

DETAILED DESCRIPTION OF THE PREFERRED EMBODIMENTS

Figure 1:
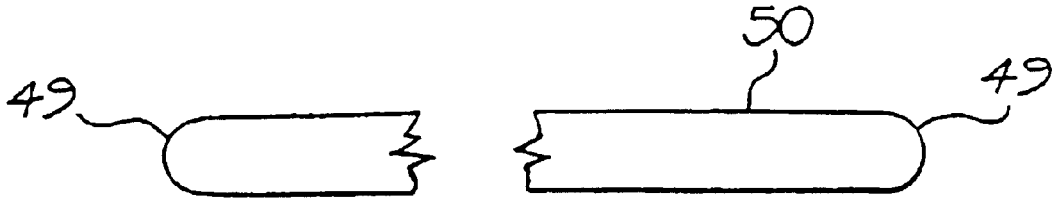
FIG. 1 illustrates a web for use in the practice of the invention.
Figure 2:
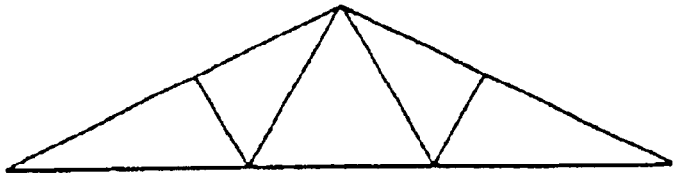
FIGS. 2 to 4 show three common forms of truss, respectively having two, four and six webs on each side, configured conventionally with equal panels in the upper chords and equal panels in the lower chords.
Figure 3:
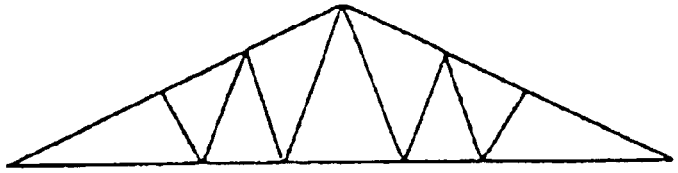
Figure 4:
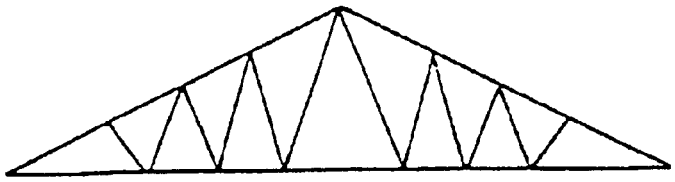

Illustrated in FIG. 1 is a web 50 made for the purposes of the invention, provided with semi-circular ends 49 the radius of which is one half of the web width. While end shapes other than a semicircle may be used, as described below, this is the preferred form.

In accordance with the invention, either at the mill or in the truss factory, webs are cut with such ends, in a standard range of lengths. The optimum length range and the optimum increment by which web length increases from one standard length to the next will to some extent depend on the range of truss types and sizes being manufactured, but as a guide, in the manufacture of roof trusses for housing in Sydney Australia, lengths in 150 mm increments between 150 and 3600 nm have been found suitable. The increments by which the length of the webs increase need not be equal, and benefit may be found in some applications in adopting a scheme whereby the length increments as a function of length, for example geometrically or logarithmically, or indeed random predetermined lengths may be employed.

Figure 5:
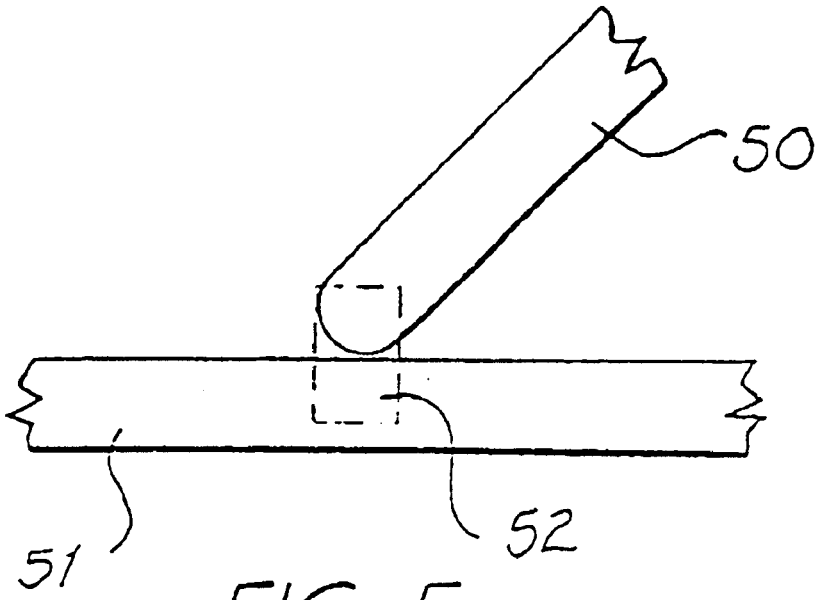
FIGS. 5 and 6 illustrate web to chord joints employing webs of the kind illustrated in FIG. 1.
Figure 6:
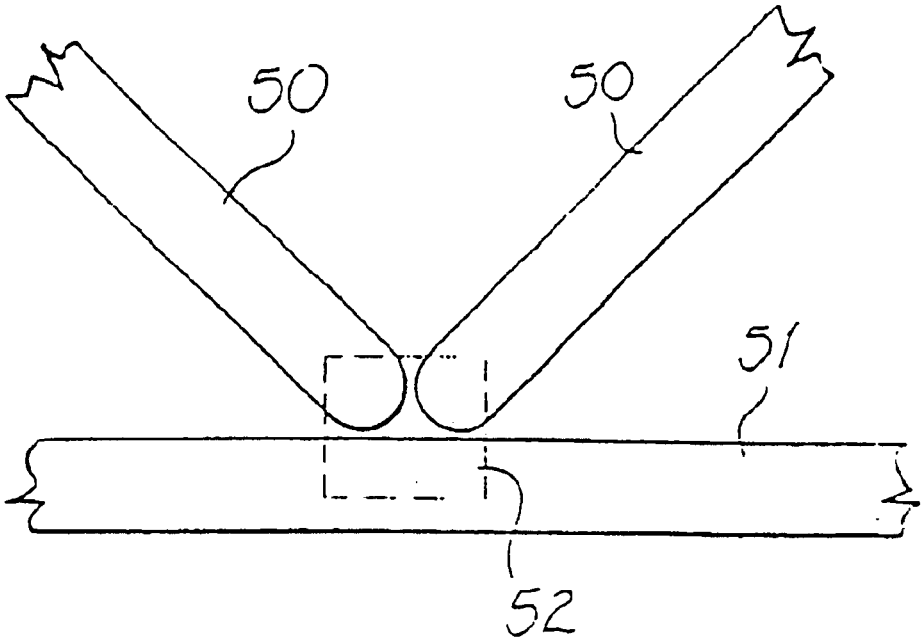

FIG. 5 illustrates a typical joint between a single web 50 and a chord 51, effected by means of a conventional nail plate 52, while FIG. 6 shows a joint involving two such webs. The use of nail plates in the fabrication of wooden trusses is well known, and conventional nail plates may be used in conjunction with the present invention.

Figure 9:
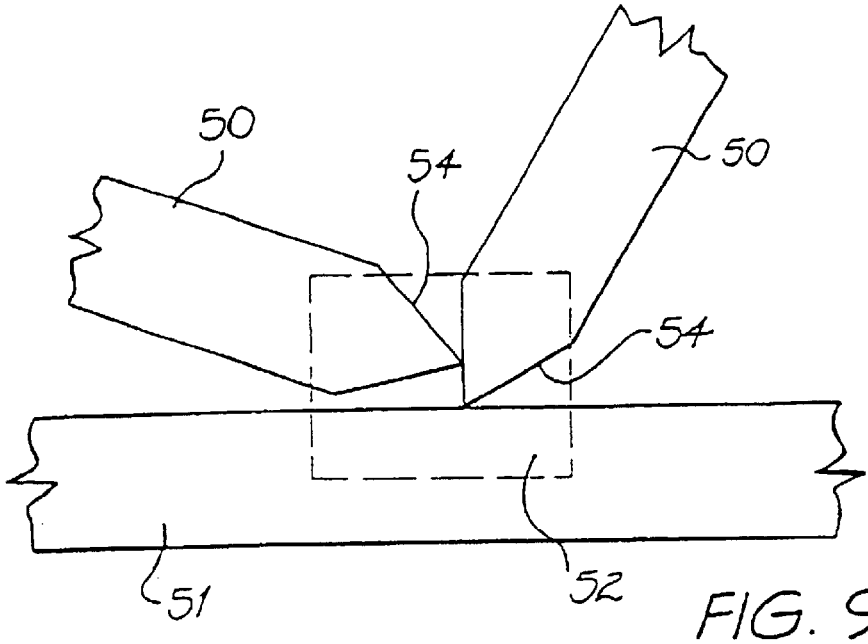

FIG. 7 shows a joint in which the web ends instead of being semi-circular are formed with a radiused end and a tapering section 53 on one side. FIG. 8 shows a joint in which the web ends have a taper 53 on both sides and a radiused end of consequently smaller radius. An extreme example is shown in FIG. 9, which shows a joint in which the web ends are simply cut to form oblique faces 54.

Alternative end formations may be employed, for example the standard end may consist of a series of cuts at successive angles, or a combination of such cuts with radiused portions.

What all such shapes including the preferred semicircular shape have in common is the provision of some form of taper, which reduces the gap which will be produced between the ends of the webs and the chord, and between abutting web ends. Of these tapering shapes, the semicircular shape is preferred for the reason that the gap between the chord and a pair of web ends, or between a single web and a chord, is constant for varying web angles.

The web selection methods of the invention for such truss types will now be described. As a matter of convenience, and because it may best introduce the reader to the concepts involved, the alternative methods of web choice will be described first, followed by the most preferred method.

The first methods to be described make use of the concept of panel point zones which are chosen by first determining in accordance with criteria adopted for the purpose, the maximum allowable panel lengths for the chords, for a given choice of factors which may include chord section and grade, web configuration, chord length and truss loading.

The maximum allowable panel lengths may be determined from first principles, based on the allowable loading of the timber sections in question. The maximum allowable panel lengths determined in this way may differ for the different panels of each chord.

Other methods may be employed for the determination of the allowable panel lengths. For example, the lengths may be determined by examining the panel lengths in a conventionally designed truss for the maximum span allowed for that truss type for the timber section and quality to be employed. In such a conventionally designed truss, the equal panel lengths will not be equally stressed, so deriving the maximum allowable panel length in this way will give a conservative figure.

In the preferred practice of the invention, panel point zones, or at least the panel point zones after the first zone in the sequence of web placement, are determined initially as provisional zones, by providing the minimum number of substantially equally overlapping maximum allowable panel lengths in each chord. The provisional panel point zones are the regions of overlap of these panel lengths. The panel point zones after the first from the starting point are revised upon the determination of the location of the preceding panel point on the chord in question, again by reference to the maximum allowable panel length or by calculation. The webs are then chose, either by the method of establishing all possible combinations and then choosing the combination which best satisfies the chosen criteria, or by choosing successive webs according to one of the other methods described above.

In the case where web lengths are determined progressively, it may occur that there is no available web length between the last located panel point and any point in the next panel point zone. In such a case the previous web is replaced by an alternative, preferably the next incremental web length away from the starting extreme, and the next web selection reiterated. If again no web length is suitable, the previous web is again replaced, by the next length again away from the extreme, and so on. Where this procedure does not produce a result, then the web preceding this immediately preceding web is substituted in the same way, until a fit is found. Where no fit can be found in this way, the number of webs is increased and the procedure repeated until a fit is found.

The application of this approach to the design of a symmetrical truss with four webs per side will now be described.

The truss design will normally take place within the context of the parameters of truss sizes, chord materials and loadings standardised for normal production for the plant. A typical set of such parameters may be as follows:

Span range: To 10000 mm

Pitch range: 18 to 26 degrees

Preferred top chord material: F5 JD5 90×35 mm kiln dried pine

Preferred bottom chord material: F5 JD5 90×35 mm kiln dried pine

Roof Loadings: Terra Cotta tiles

Ceiling Loadings: Plasterboard 13 mm

Design wind speed: 41 m/sec

Top Chord bracing: Tile battens @ 300 mm ctrs

Bottom Chord bracing: Bracing at 1800 mm ctrs

For these parameters a suitable top chord maximum allowable panel length may be for the truss in question 2100 mm, and for bottom chords 2700 mm.

Figure 10:
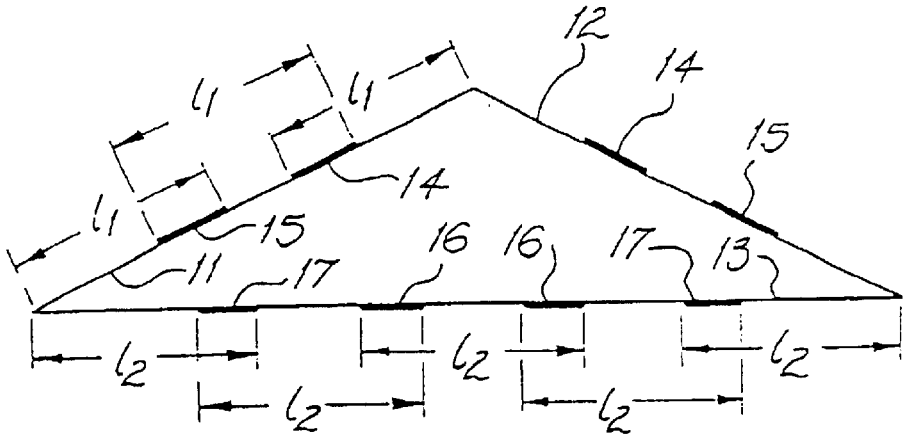
Figure 11:
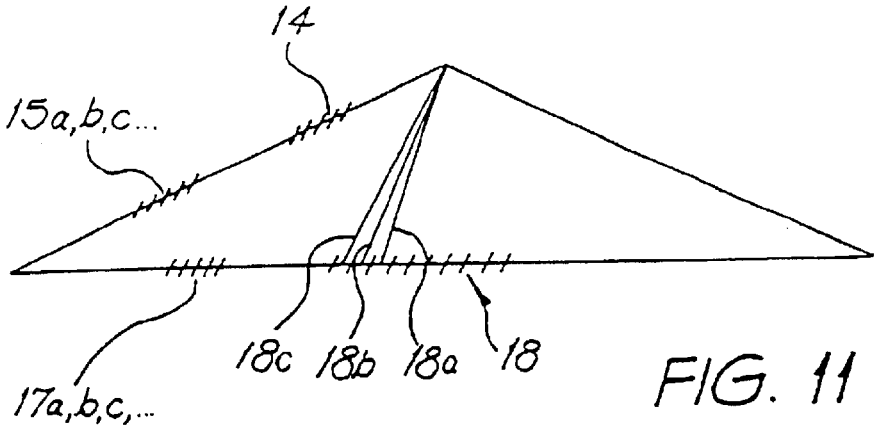

The span and pitch of the truss and the material section determine the internal or external triangle of the truss and the dimensions of the chords. Once this is determined, the next step is to locate the panel point zones, by locating substantially equally overlapping units of the maximum allowable panel lengths $l_1$ and $l_2$ along the respective chords from the apex and from the heels as shown in FIG. 10.

In the present example two such zones 14 and 15 are determined on each of the top chords 11 and 12, while the bottom chord 13 has two pairs of zones 16 and 17.

The preferred starting point for the web selection is the apex of the truss, since this is a fixed location. While it is possible to work from the heel towards the apex, this has the difficulty that the end point of the process is inflexible, unless one is prepared to tolerate a truss in which the central webs do not meet the upper chords at the apex.

In the following description, the choice of webs will be discussed in relation only to the left-hand side of the truss as viewed in FIG. 10, since the truss is symmetrical and the same results will be obtained on the other side.

Where the truss design is to be solved by determining all possible web combinations which satisfy the available stock lengths and the panel point zones, the possible choices of first web 18 (FIG. 11) are determined, shown in this example as 18*a*, 18*b* and 18*c*.

Figure 12:
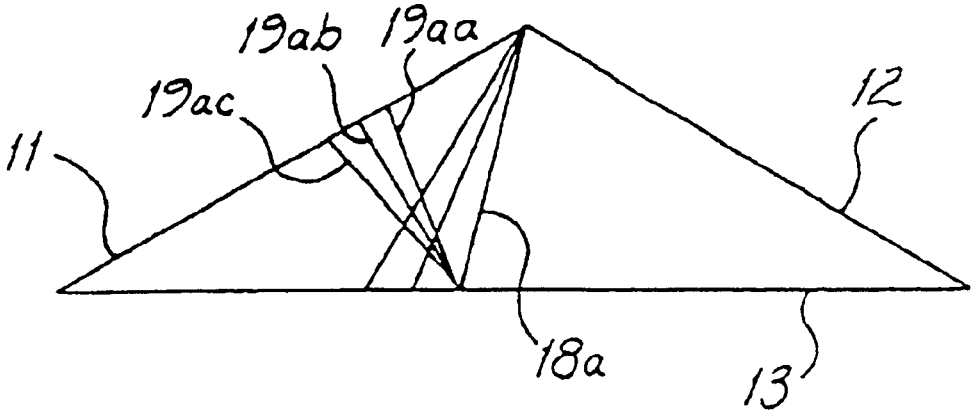
Figure 13:
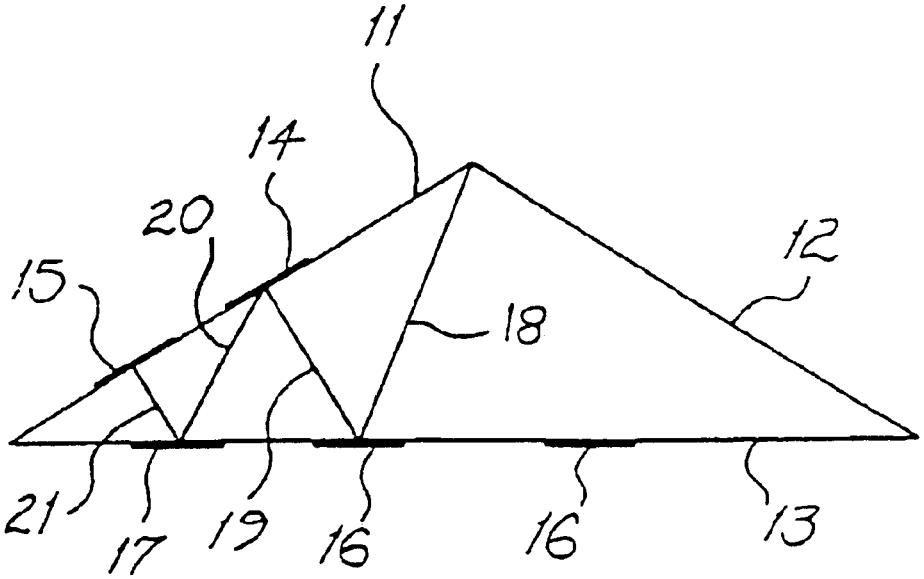

For each of these solutions for the first web 18, the family of webs 19 meeting the target panel point zone 14 is then determined. In the example shown in FIG. 12, for the case of web 18*a*, the possible family is 19*aa*, 19*ab*, 19*ac* (FIG. 12). It is to be observed that a web may be capable of meeting a panel point zone in two places. In such a case, both possibilities will preferably be used.

For each of the possible webs 18*a*, 18*b* and 18*c* (FIG. 11), the target panel point zone 17 is re-calculated by measuring out the relevant maximum allowable panel length from each of the panel points of these possible webs, producing a family of overlapping zones 17*a*, 17*b*, 17*c*. Similarly for each member of the family of possible webs 19, such as 19*aa*, 19*ab*, 19*ac* (FIG. 12), a family of target panel point zones 15*a*, 15*b*, 15*c*, . . . is calculated.

This procedure is repeated along the truss until all web families have been determined. At this point a large family of trusses will have been generated, each of which could be manufactured from the available stock.

Preferably, each of these truss designs is examined to identify those which incorporate web geometry which is undesirable, for example, where the minimum included angle between a web and the chord to which it is attached is not reached for unopposed joints of webs which are to act in, or may go into, compression. In such cases the truss may be deleted, or the joint modified to provide opposition for the web, for example by adding a block attached to the chord or by adding a further web.

Once such exceptions have been taken case of, a choice is made between the remaining truss solutions, on the basis of a predetermined criterion or set of criteria. Preferably, this is done by comparing each of the trusses with a truss which would have been manufactured using prior art techniques. The preferred method of comparison is to take one truss at a time, and measure the distance between each panel point of the truss and the corresponding panel point of the prior art truss. Each of these distances is then totalled for each truss. The chosen truss will be the one which has the smallest total, indicating close correspondence with the prior art solution.

As indicated above, some other basis of choice may be made, for example based on the quantity of timber used by each truss solution.

An example will now be described of the way in which the truss may be determined by the sequential selection of webs by the adoption of webs which satisfy a parameter extreme, in this example, the web which lands at a point in the target panel point zone which is closest to the starting point of web selection.

The first web 18 (FIG. 13) is chosen as that web from the stock lengths of web which will extend from the apex and contact the bottom chord within the zone 16 at the point closest to the centre of the truss. With the selection of this web, the panel point zone 17 can now be determined by measuring out the relevant maximum allowable panel length from the panel point of the web 17 towards the heel.

The next web to be chosen, web 19, is that having the stock length which will extend from a joint at the lower chord adjacent the web 18, and strike the upper chord 11 within the provisional panel point zone 14, closest to the apex of the truss. The selection of web 19 then allows the determination of panel point zone 15. Similarly, the next web 20 is chosen as the stock length which will extend from the joint with web 19 on the upper chord 11 and contact the lower chord 13 within the panel point zone 17 and closest to the centre of the truss.

Finally the web 21 is chosen as the stock length which will extend from the joint with web 20 on the lower chord 13 and contact the upper chord 11 within the provisional panel point zone 15, closest to the apex.

Before the web layout thus arrived at can be considered complete, the angle of contact between compression webs (or tension webs which may go into compression, for example under wind uplift) and the chord at an unopposed joint (i.e. a joint comprising a chord and only one web), should be checked to ensure that it is not so small as to be unacceptable for the nail plate fixing employed. It will be found convenient to adopt a minimum angle based on testing of such joints, and to reject designs which produce an angle at an unopposed joint which is less than this minimum angle. With the parameters employed in the present example, such a minimum angle may be found to be in the region of 10 to 30 degrees.

Where the web angle is found to be less than the minimum, it will be necessary either to revise the preceding web choice, or to use other expedients such as the use of a block attached to the chord to provide opposition for the web, or add a further web to provide this opposition.

Figure 14:
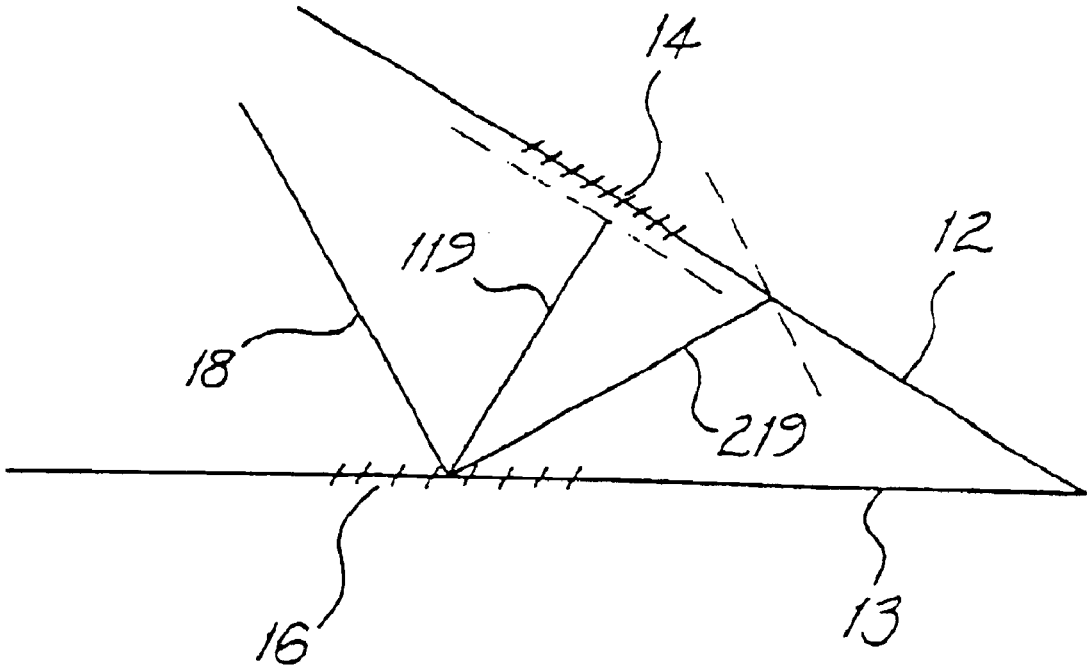

FIG. 14 illustrates a case in which web length selection must be reiterated to achieve the truss design. Here it is shown that after the initial choice of the web 18, in seeking the correct length for the next web it is found that while the web length 119 is too short to reach the zone 14, the next longest web 219 is too long. In this case the web 18 is replaced by the next greater stock length landing in the target panel point zone 16, i.e. the next stock length web landing away from the apex of the truss. This will generate a new starting point for the next web, whereupon it may be found that the web 119 or a web of another stock length reaches the provisional zone 14.

Should this reiteration of the procedure not produce a workable choice for the next web, the first web length is again incremented, and a fit for the second web sought afresh.

It will be understood that this procedure will be used to overcome the absence of a suitable web length at any of the successive web locations along the truss. In an extreme case it may be necessary to carry the reiteration of length determination back for more than one web in the sequence.

In the case where the first web choices are exhausted without finding a suitable truss, or without finding an available web length for a given web, then the configuration of the truss must be revised, increasing the number of webs.

In most cases it will be found that more than one set of webs can be found for a given truss, if the designer experiments with different starting web lengths or substitutes intermediate webs. In such cases, even where the method of determining webs successively is employed, the manufacturer may prefer to generate a family of possible web choices for a given truss, and choose from among these the pattern of webs which best suits the application, for example by providing room for air-conditioning ducts, or for personnel access in the roof. Indeed, the designer conscious of such additional design parameters will modify his choices of web length at the appropriate part of the truss to take these into account, choosing, for example, a longer web at a particular point than would otherwise be suggested by the simplest form of the method described above.

In conjunction with the approach to truss design thus described, a further modification to normal practice can be of advantage. In this modified approach, joints comprising more than one web end are modified so that the web ends are spaced along the chord (or, at an apex, their respective chords). Preferably a standard spacing is adopted which is compatible with the structural requirements of the truss, but the spacing may be varied within a given truss, and not all joints may be designed in this way. A typical spacing of the web ends in roof trusses may be 200 mm.

The use of open joints of this kind provides several advantages in the method of the present invention. The panel point zone may be extended, and consequently the number of web lengths in the stock family may be reduced, by increasing the length increment between successive stock lengths. This approach will also enable some trusses to be constructed with less webs than otherwise. For example, a truss which had to be constructed with six webs per side because a web length/zone fit could not be found for the case of four webs per side may, with spaced joints, have four webs per side.

The methods thus described may be implemented by computer or conducted manually. Computer implementation will be of particular benefit where it is desired to generate a family of web solutions.

Figure 15:
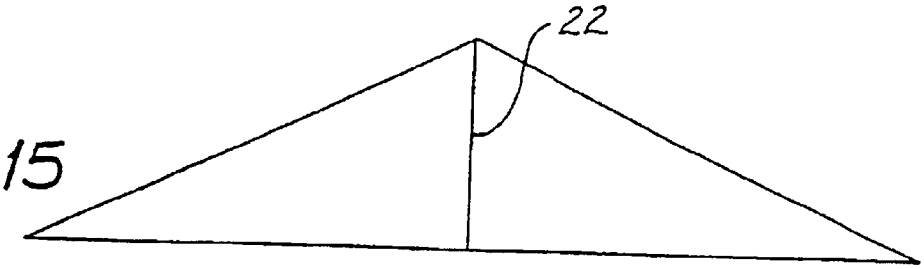
Figure 16:
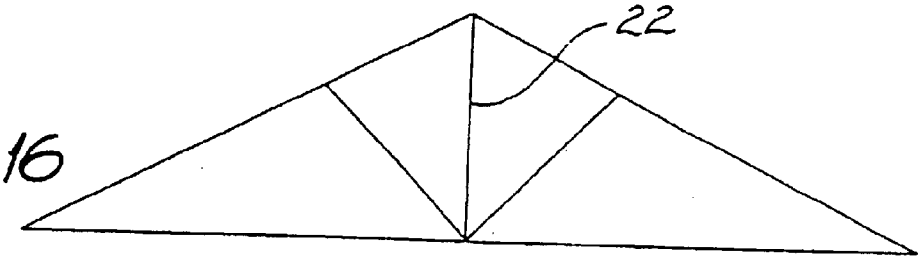
Figure 17:
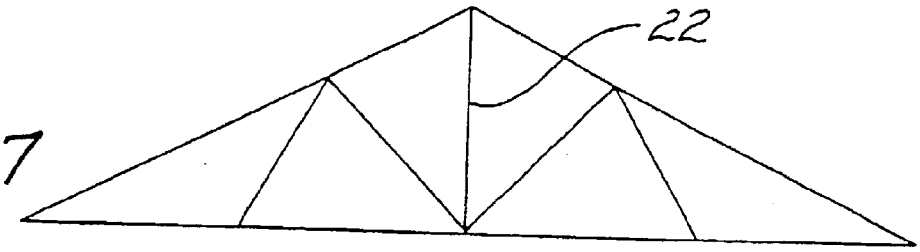
Figure 18:
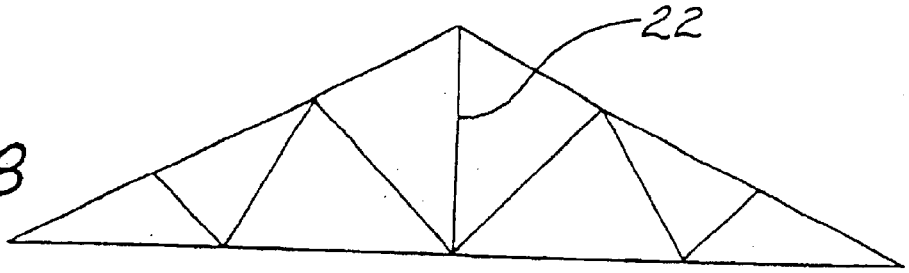
Figure 19:
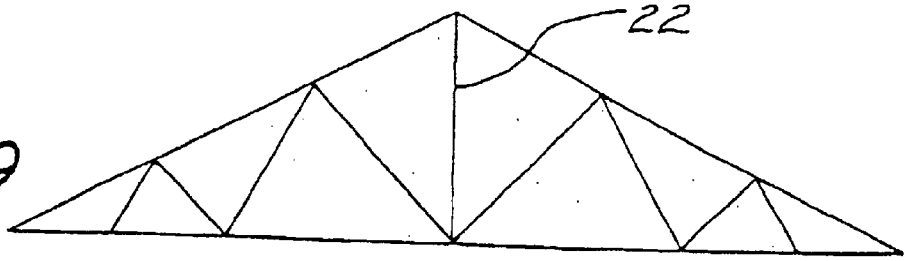

FIGS. 15 to 19 illustrate another approach to the web selection process, foreshadowed above and having the advantage of starting with a clearly defined chord geometry. In this method, as shown in FIG. 15 there is first provided a king post 22 cut to the correct length if necessary, descending vertically from the apex of the web. By fixing such a web in position before fixing the remaining webs the chords are now fixed in position with an accurately defined apex height, whereas in the methods previously described the truss triangle was not fixed until web installation was substantially complete.

The subsequent webs may now be selected according to the method and criteria described above, leading to the development of trusses as shown in FIGS. 16 to 19.

A preferred method of web selection, which is particularly well adapted to embodiment in computer software, will now be described.

In the truss illustrated in FIG. 20, each of the upper chords is, as is conventional, divided into equal panel lengths to define upper chord notional panel points 23 and 24. Parallel lines 25 and 26 are then drawn intersecting the upper chords at each of the notional panels points to define at their intersections with the bottom chord, notional panel points 27 and 28. The angle between the relevant upper chord and the lines 25 and 26, which may be regarded as notional web lines, is suitably 90 degrees, but other angles may be used and chosen on structural principles or by experiment In the example illustrated, an angle of 90 degrees will be used.

Lines 29 and 30 are shown as the notional web lines joining the apex and panel point 27, and panel points 23 and 28.

The object of the web selection method now employed is to select webs which determine panel points on the bottom chord having a close correspondence with the notional panel points. This is done by starting (preferably) at the apex of the truss, and choosing for each side of the truss the greatest web length 30*a* which will produce a joint at or on the near side of the notional panel point 27. In other words, the web length chosen is the longest in the stock of lengths which is not greater than the distance between the apex and the notional panel point 27.

From the actual panel point 27*a* thus established on the lower chord 13, a line 25*a* is drawn parallel to the line 25 intersecting the upper chord 11. The next web 31 is chosen as the web within the shortest stock length which is not less than the distance between the panel point 27*a* and the intersection of the line 25*a* with the upper chord 11.

Except in the rare case that there is a stock length equal to this distance, the web 31 can form a joint with the upper chord in either of two locations, one on each side of the line 25*a*. Preferably the web is positioned with its joint on the upper chord on the side of the line 25*a* remote from the apex, since in this way the resultant web layout will most closely approximate the notional layout. The location of the resulting panel point 25*b* relative to the notional panel point 23 will depend on the length of the web 31 and the other relevant parameters of the web, but it will be found that for a practical choice of web length increments as discussed above, the point 25*b* will be quite close to the notional point 23.

This process is repeated, with the web 32 being chosen for the greatest length from the stock lengths which will produce a joint at or on the near side of the notional point 28, and the web 33 as the shortest stock length which is not less than the distance between the panel point 28*a* and the intersection of the line 26*a* with the upper chord 11. As in the case of the web 31, the web 33 is positioned with its upper panel point on the side of the line 26*a* remote from the apex (i.e. closest to the notional panel joint 24). The effect of this methodology will be seen to be to group the actual panel points as closely as possible to the notional points, with a simple, unambiguous basis for web length choice in each case. It may also be observed that by choosing the angle between the upper chord 11 and the notional web lines 26 as 90 degrees, the likelihood that an unopposed web to chord joint such as that of the web 33, will be made at an angle less than the minimum web angle discussed above, is very small, since such a large departure from parallelism between the actual web line and the line 26*a* is unlikely.

This last described method may be varied, if desired, for example by reversing the sides of the lines 25 and 26 and/or 25*a* and 26*a* on which the respective web ends fall.

As in the methods previously described, the web layout thus arrived at will be checked for compliance with the predetermined minimum web angle, and if this requirement is not satisfied, then either a block will be added to the chord to oppose the web at the offending joint, or a further web added for this purpose. Alternatively, the designer may choose to repeat the web selection process for a truss with an additional web on each side.

Preferably, the truss will also be checked to ensure that the panel points established by this process of web selection satisfy the structural requirements of the truss application. This can be done by checking the truss by first principles, or by determining that the panel point land within the panel point zones determined as described above. If this is not the case, then one or more webs should be added to the design and the web selection process repeated.

While this last methodology has been described in terms of working from the apex (or other point of chord angle change) it is to be appreciated that this method also may be practiced by starting elsewhere, for example at the notional panel point closest to the heel of the truss, with choices of the alternative actual upper panel point locations being made, as above, preferably in a way which results in a web layout approximating the notional layout. Other starting points may be chosen, for example on the notional panel points on either chord, or any point within any panel point zone, or at a panel point determined by prior art methods.

The invention may be applied to trusses other than the simple end-supported gable trusses discussed so far. Examples of other trusses to which the invention may be applied are cantilevered trusses where differing panel lengths may apply in the cantilevered portion of the truss, or trusses with additional supports, truncated trusses, mono and cut-off mono trusses, cut-off gable trusses and valley trusses. In all these and other cases not listed here the same basic procedures described above may be practised.

It will be understood that there may be instances where, because of the type of truss, or the need to include an extreme web to truss angle, one or more conventionally cut webs of non-standard length may have to be incorporated in a particular truss. The invention extends to such mixed trusses, where the time and labour saving offered by the use of the invention will still largely be obtained.

What is claimed is:

1. A method of computer-design of a wooden roof truss having a bottom chord and at least one upper chord obliquely disposed relative to the bottom chord, said upper chord and said bottom chord to be connected by at least one web via nail-plated joints, said method including the steps of:

setting a plurality of web designs having tapered end shapes at each end thereof and being of discrete web lengths at increments between minimum and maximum web lengths, said plurality of web designs, tapered end shapes and discrete web lengths being predetermined without knowing shape, pitch and span of said wooden roof truss to be designed;

computer-generating a truss design for said wooden roof truss via truss design software, said truss design software taking into consideration the shape, pitch and span of the wooden roof truss to be designed and calculating target joint locations for joints between webs and chords of said truss to be designed, said truss design software then taking into consideration said plurality of web designs and said calculated target joint locations by applying predetermined criteria to sequentially select web designs from said plurality of web designs to result in actual joint locations which satisfactorily approximate said target joint locations.

2. A method of computer-design of a wooden roof truss according to claim 1 wherein in said sequential selection step each web design is selected by said truss design software taking into consideration the actual joint location resulting from an immediately previously selected web design and a next said target joint location and applying said predetermined criteria.

3. A method of computer-design of a wooden roof truss according to claim 1 wherein said tapered end shapes of the web designs are substantially identical.

4. A method of computer-design of a wooden roof truss according to claim 3 wherein said tapered end shapes are substantially semicircular.

5. A method of computer-design of a wooden roof truss according to claim 3 wherein said tapered end shapes are formed as a series of cuts at successive angles.

6. A method of computer-design of a wooden roof truss according to claim 5 wherein said series of cuts at successive angles forms a convex, substantially arcuate end shape.

7. A method of manufacturing a wooden roof truss, including the steps of:

designing the truss by a method according to claim 1;

selecting one or more webs for use in said truss from a stock of webs having a substantially identical end shape and discrete lengths at increments between said minimum and maximum web lengths; and assembling said wooden roof truss according to said design using said one or more webs.

* * * * *